US008006534B1

(12) United States Patent
Broberg et al.

(10) Patent No.: US 8,006,534 B1
(45) Date of Patent: Aug. 30, 2011

(54) WIRE OR ROD BENDER

(75) Inventors: James E. Broberg, Crystal Lake, IL (US); Steve J. Wildkatsch, Grayslake, IL (US); Edward P. Bojan, Glenview, IL (US)

(73) Assignee: Du-Bro Products, Inc., Wauconda, IL (US)

( * ) Notice: Subject to any disclaimer, the term of this patent is extended or adjusted under 35 U.S.C. 154(b) by 0 days.

(21) Appl. No.: 12/806,013

(22) Filed: Aug. 4, 2010

(51) Int. Cl.
*B21D 31/00* (2006.01)

(52) U.S. Cl. ..... 72/387; 140/102.5; 140/123; 72/371; 72/479

(58) Field of Classification Search ..... 72/296, 72/298, 299, 371, 387, 388, 458, 479, 480, 72/157, 306, 307; 140/102.5, 123, 149
See application file for complete search history.

(56) References Cited

U.S. PATENT DOCUMENTS

| | | | | |
|---|---|---|---|---|
| 365,416 | A | 6/1887 | Warner | |
| 456,533 | A | 7/1891 | Bold | |
| 550,991 | A | 12/1895 | Meyer et al. | |
| 1,261,550 | A * | 4/1918 | Kilmer | 72/157 |
| 1,419,476 | A | 6/1922 | Smith | |
| 2,425,031 | A * | 8/1947 | De Wald | 72/125 |
| 2,430,899 | A * | 11/1947 | Wallace | 72/388 |
| 2,456,532 | A * | 12/1948 | Perazzo | 72/412 |
| 3,585,662 | A * | 6/1971 | Boyajian | 7/158 |
| 4,392,518 | A * | 7/1983 | Stant | 140/119 |
| 4,751,840 | A * | 6/1988 | Windsor, Jr. | 72/478 |
| 4,869,298 | A * | 9/1989 | Motley | 140/102.5 |
| 5,520,227 | A * | 5/1996 | Kelley | 140/102.5 |
| 5,680,789 | A * | 10/1997 | Brooke | 72/458 |
| 5,809,824 | A * | 9/1998 | Hiltzman | 72/387 |
| 5,853,033 | A * | 12/1998 | Kavanagh | 140/123 |
| 6,173,598 | B1 | 1/2001 | Caporusso et al. | |
| 7,104,287 | B1 * | 9/2006 | Schmitz | 140/118 |

* cited by examiner

*Primary Examiner* — Edward Tolan
(74) *Attorney, Agent, or Firm* — Mathew R. P. Perrone, Jr.; Brie A. Crawford

(57) ABSTRACT

A wire bender or a rod bender and more particularly a wire bender or a rod bender, adaptable to bend a variety of sizes of rod or wire to at least one desirable angle, provides a bent wire or a bent rod may be formed to use with a model, especially a model of vehicle.

14 Claims, 6 Drawing Sheets

WIRE OR ROD BENDER

This invention relates to a wire bender or a rod bender and more particularly to a wire bender or a rod bender, adaptable to bend a variety of sizes of rod or wire to at least one desirable angle, so that bent wire or a bent rod may be formed to use with a model, especially a model of a vehicle.

BACKGROUND OF THE INVENTION

In a building process for a model, especially a model of a vehicle, it is desirable to bend wires or rods at proper angles for use in constructing the model. Typical vehicles, for which models are made include, but are not limited to, automobiles, airplanes, boats, and the like. A plurality of properly bent wires or rods are very useful in these model building procedures.

Additionally, certain precise angles are almost mandatory to achieve the proper results for the model. While some proper results are desirable for appearance purposes, other proper results are required for proper operation. Such a proper operation is especially critical in those powered models such as airplanes, or automobiles. If the proper angles on those rods or wires are not achieved, the power functioning of those models is adversely affected.

Because there is no consistent size of the rods or wires used in the models, the diameter thereof is constantly changing. Such a change in diameter complicates achieving the proper bends. These wires or rods are required to be at least semi rigid, if not rigid, but bendable for use as a part in a model vehicle. Such rigidity complicates the proper bending thereof. The change in diameter of the rods or wires adds a further complication. Unless otherwise specified, the terms, rod and wire, may be used interchangeably.

It is difficult to accomplish the proper bending with a hand tool. Such bending is more an art than a science and requires substantial skill to achieve the proper angles. This is especially true because a part formed from the wire or the rod is required, in most cases, to have symmetrical shaping. Such symmetrical shaping requires a plurality of bends. With the plurality of bends, symmetry becomes an even greater problem.

It is also difficult to accomplish the proper bending with a power tool. As power is added, the tool operation becomes complex. Simplified bending on the wire or the rod can provide great advantages to a person desiring to make a model. Such simplification furthermore makes the model building hobby available to a person who might lack the appropriate dexterity to bend the wire or the rod properly.

Thus, a proper solution to these problems appears to being a mechanical device capable of accepting the desired rod or wire, and bending the same as desired. The differing sizes caused problems enough for such a device. The problem of controlling the rod or wire while it is being shaped as desired adds further complications to the complication.

No appropriate mechanical device for achieving applicants' desired goals is available. Nevertheless, such a device can offer great advantages to the model maker, and greatly increase the enjoyment of the model.

SUMMARY OF THE INVENTION

Among the many objectives of the present invention is the provision of a wire or rod bender for use by a model builder.

Another objective of the present invention is the provision of a manual wire or rod bender for use by a model builder.

Moreover an objective of the present invention is the provision of a wire or rod bender, with a changeable die.

A still further objective of the present invention is the provision of a wire or rod bender, capable of holding the item sought to be bent.

Yet a further objective of the present invention is the provision of a wire or rod bender, capable of repeating an angle of the item sought to be bent.

Also, an objective of the present invention is the provision of a wire or rod bender, capable of varying an angle of the item sought to be bent.

These and other objectives of the invention (which other objectives become clear by consideration of the specification, claims and drawings as a whole) are met by providing a wire bender, with an interchangeable die to provide a desired shape for a wire or rod to be used in a model, especially a model vehicle.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
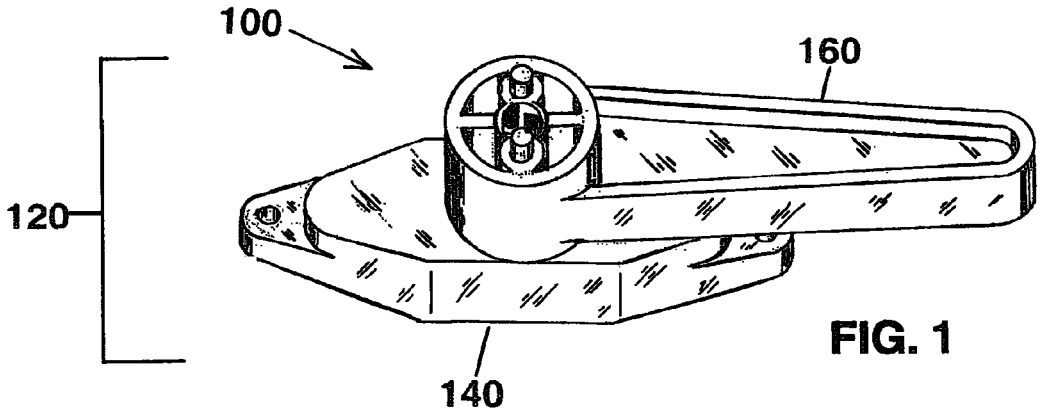
FIG. 1 depicts a perspective view of wire bender 100 of this invention.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, down, over, above, below, beneath, rear, and front, may be used with respect to the drawings. These and similar directional terms are not to be construed to limit the scope of the invention in any manner. The words attach, connect, couple, and similar terms with their inflectional morphemes do not necessarily denote direct or intermediate connections, but may also include connections through mediate elements or devices.

Components of the wire bender include a housing with a die support movably and releasably mounted thereon with a mounting base. A die in the die support produces the desired shape of wire or rod in the wire bender. The thus shaped device can be used in a toy model or a utilitarian device.

Figure 2:
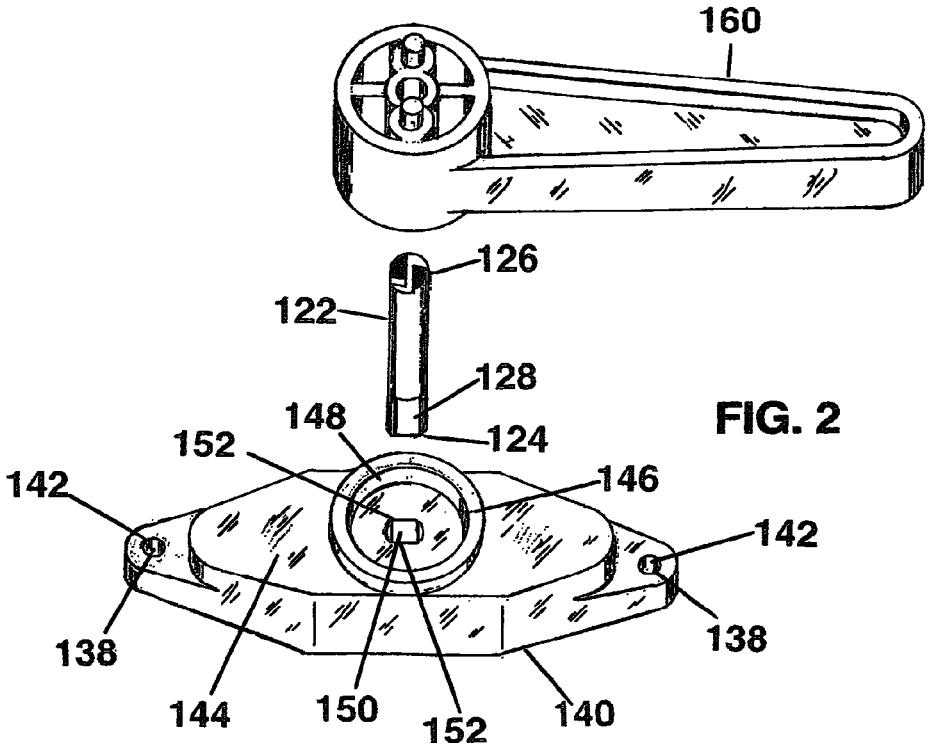
FIG. 2 depicts an exploded, perspective view of wire bender 100 of this invention.
Figure 3:
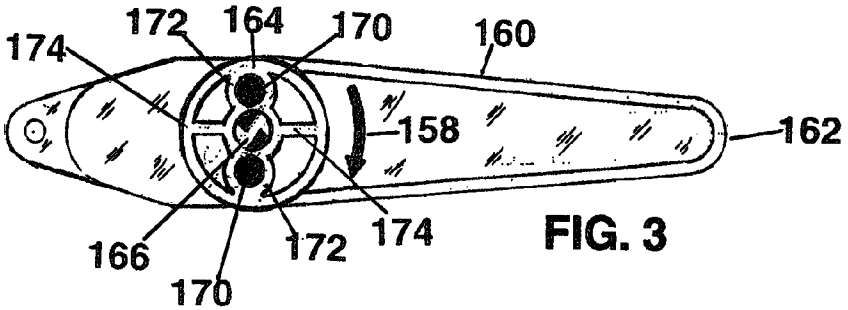
FIG. 3 depicts a top plan view of wire bender 100 of this invention.
Figure 4:
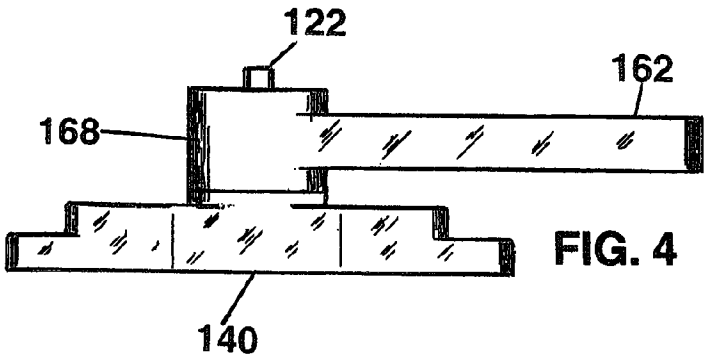
FIG. 4 depicts a side view of wire bender 100 of this invention.
Figure 5:
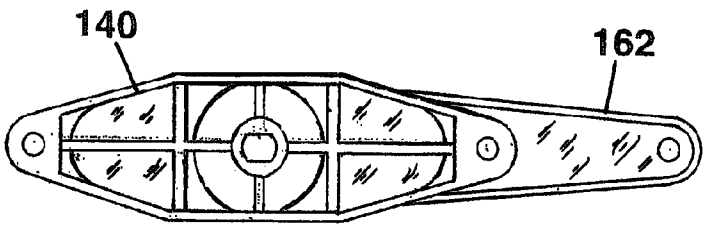
FIG. 5 depicts a bottom plan view of wire bender 100 of this invention.
Figure 6:
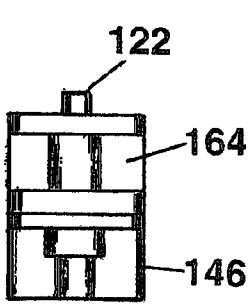
FIG. 6 depicts an end plan view of wire bender 100 of this invention.
Figure 7:
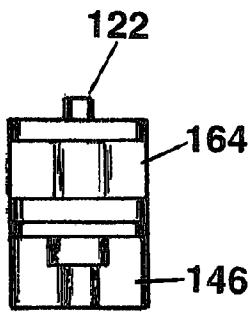
FIG. 7 depicts an end plan view of wire bender 100 of this invention and a reverse view of FIG. 6.
Figure 15:
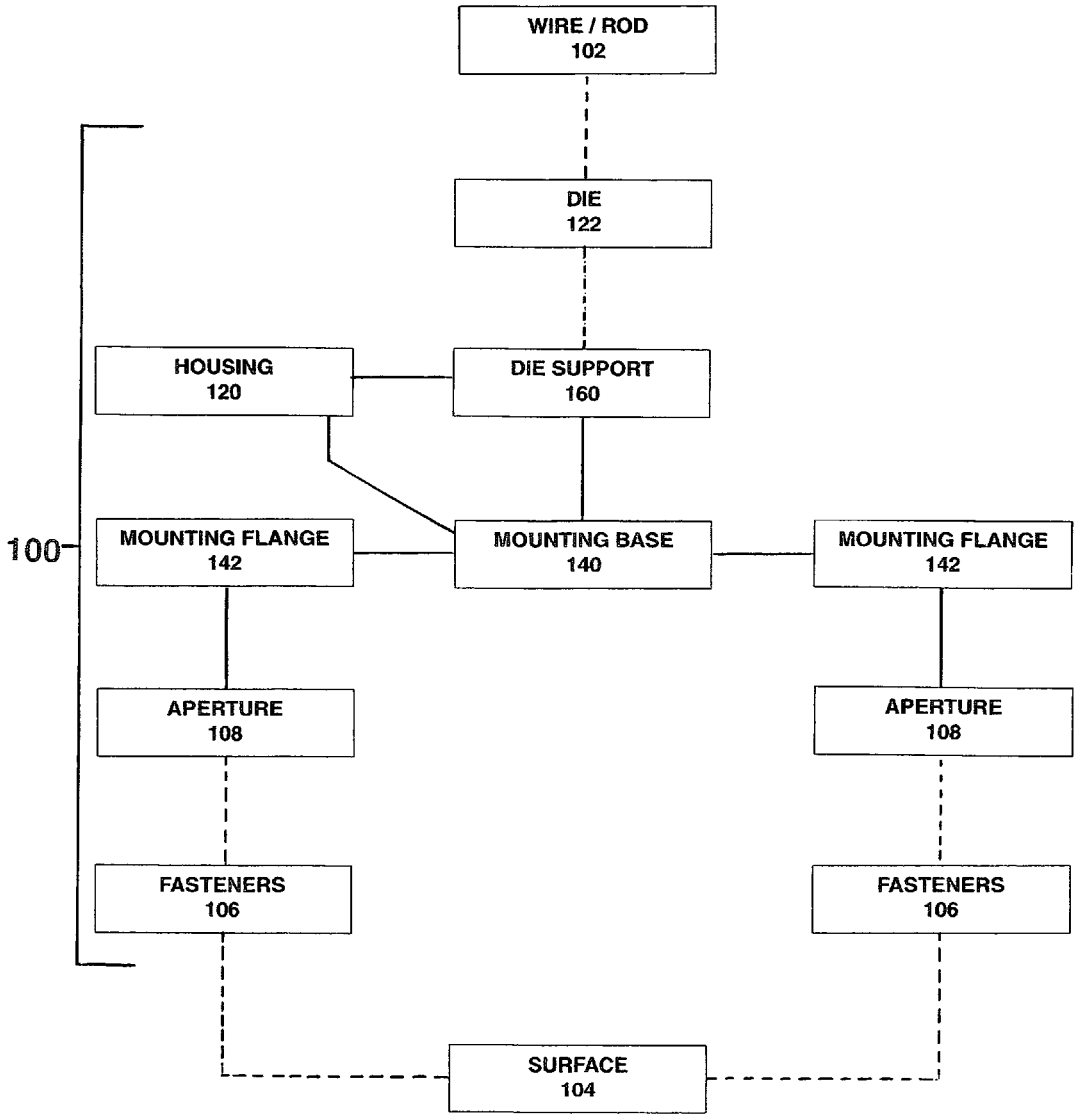
FIG. 15 depicts a block diagram for wire bender 100 of this invention.

Referring to FIG. 1 and FIG. 2, wire bender 100 has a housing 120 with a mounting base 140, and a die support 160. The mounting base 140 receives the die support 160. The die 122 fits between the mounting base 140 and the die support 160. Within the mounting base 140, the die 122 is secured sufficiently to at least reduce, and preferably eliminate, any rotation of die 122 about its longitudinal axis. Mounting base 140 includes a pair of oppositely disposed mounting flanges 142, so that mounting base 140, and housing 120 may be secured to a desired surface 104 (FIG. 15). Desired surface 104 may be a work bench, a vehicle, a portable work surface or any other secure and stable surface for mounting wire bender 100.

Further considering FIG. 2, the mounting base 140 of the housing 120 for wire bender 100 has a raised platform 144 between mounting flanges 142. In the center of the raised platform 144 is a die 122 for shaping a wire 102. The die 122 has a mounting end 124 and an oppositely disposed shaping end 126. Mounting end 124 has flat sides 128. Mounting end 124 fits into mounting base 140 at die housing 146.

A mounting flange 142 is at each end of the mounting base. The mounting flanges 142 permits the wire bender to be mounted on a desired surface. The mounting flanges 142 each include a mounting aperture 138. The mounting aperture 138 receives a screw or other fastener to mount it to a desired surface.

More specifically, centrally located between mounting flanges 142 is the raised platform 144. Centrally located within raised platform 144 is a die housing 146. Die housing 146 includes a die support mount 148 adapted to have die support 160 rest thereon. Die support 160 includes die grip 164 with handle 162 extending therefrom. Centrally located in die support mount 148 is die receiver 150 in the form of an aperture. Die receiver 150 has a pair of die flats 152, which receives the flat sides 128 of die 122 in a female to male relationship.

With the further consideration of FIG. 3, FIG. 4, FIG. 5, FIG. 6, and FIG. 7, the structure of die support 160 becomes more clear. Die support 160 includes handle 162 extending from die grip 164. Die grip 164 cooperates with die 122 and permits die 122 to bend wire 102 as handle 162 is rotated around die support mount 148. Die grip 164 has centrally located therein a shaping end receiver 166, to receive shaping end 126 of die 122. Shaping end 126 is the male portion of male to female relationship.

Die grip 164 has a shaping end receiver 166, with a cylindrical housing 168. Cylindrical housing 168 has about the same diameter as die support mount 148 and rests thereon. Adjacent to shaping end receiver 166 on opposing sides thereof are shaping support rods 170. Each shaping support rod 170 is mounted in a shaping support cylinder 172. Each shaping support cylinder 172 is substantially tangential to opposing sides of cylindrical housing 168. Between each support cylinder 172 is the shaping end receiver 166 with a preferably tangential relationship therewith.

A set of cylinder braces 174 connects shaping end receiver 166 with the cylindrical housing 168 and provides support therefor. Such cylinder braces 174 add strength to die support 160.

Figure 8:
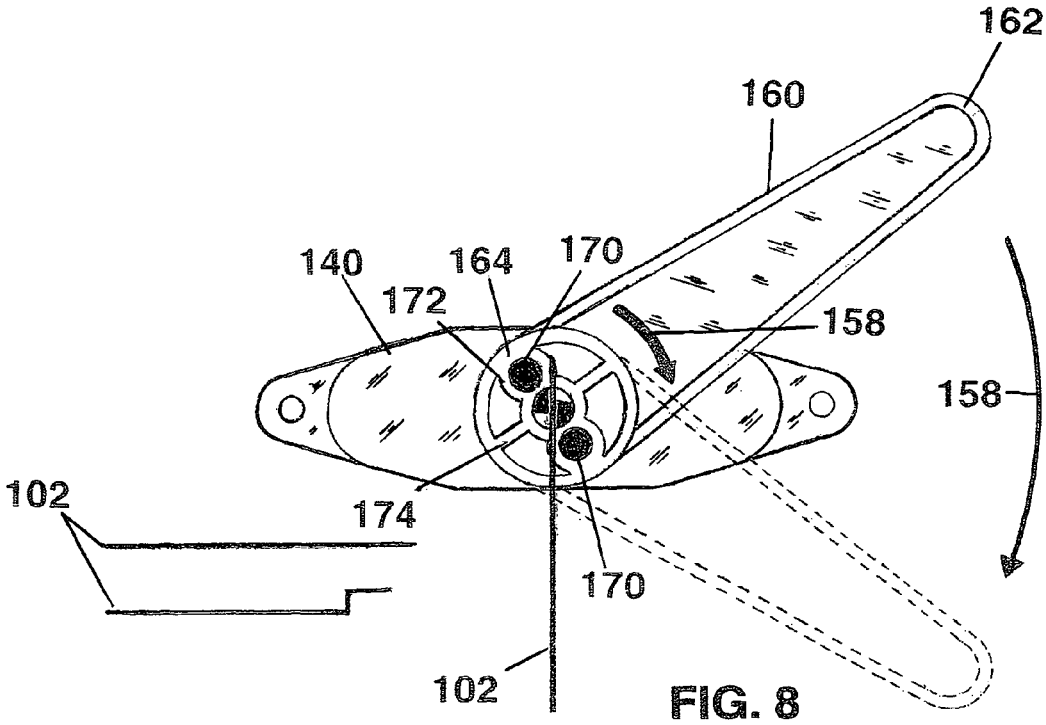
FIG. 8 depicts a top plan view of wire bender 100 of this invention, in use.
Figure 9:
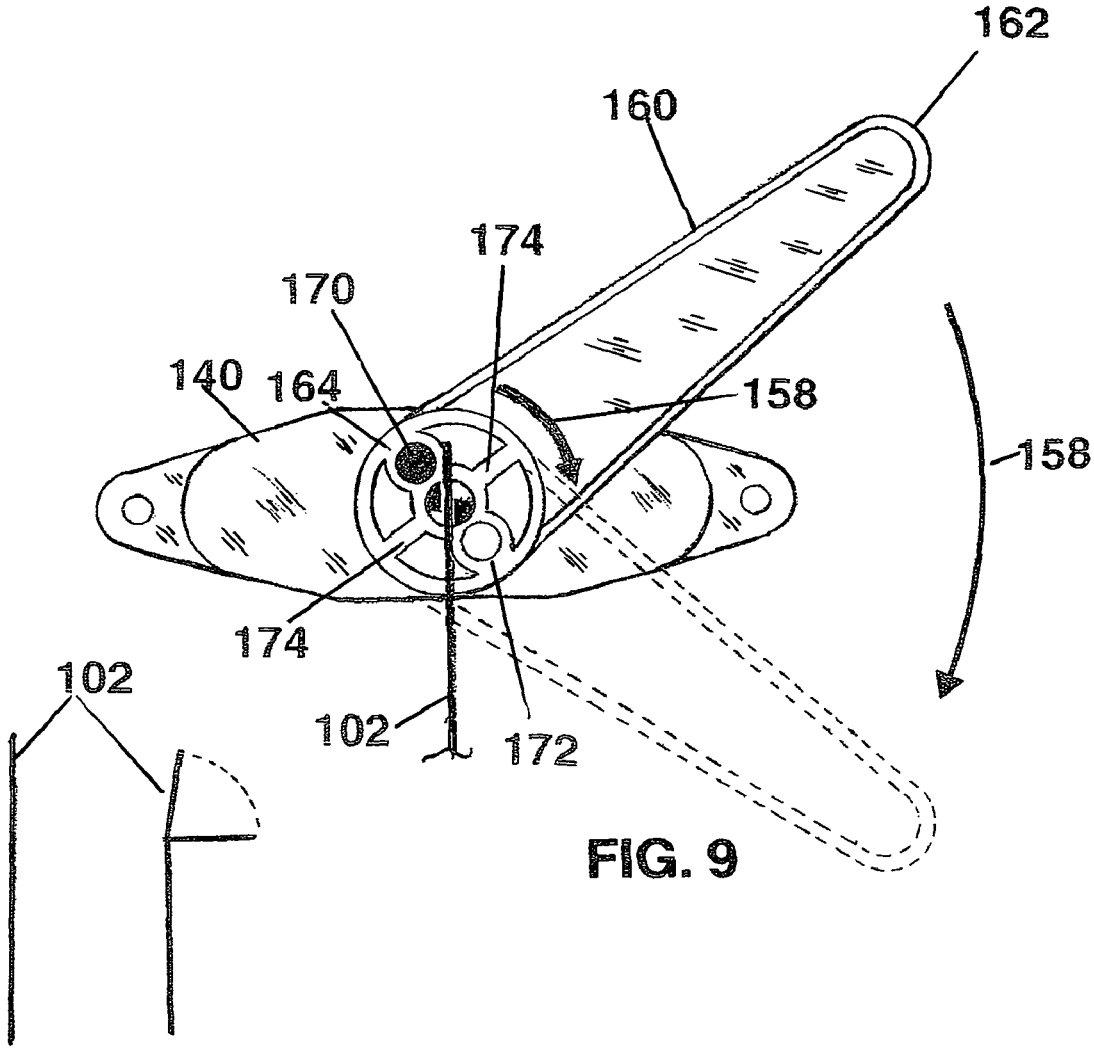
FIG. 9 depicts a top plan view of wire bender 100 of this invention, in use.
Figure 10:
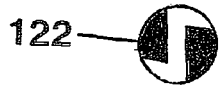
FIG. 10 depicts a top plan view of die 122 for wire bender 100 of this invention.
Figure 11:
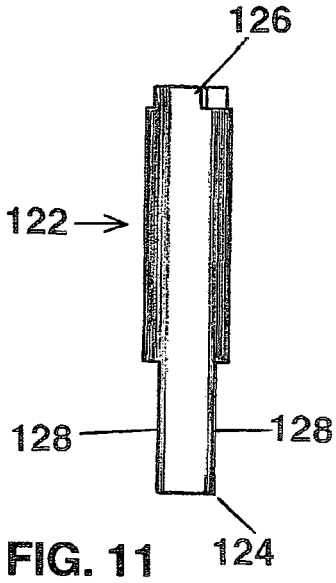
FIG. 11 depicts a side view of die 122 for wire bender 100 of this invention.
Figure 13:
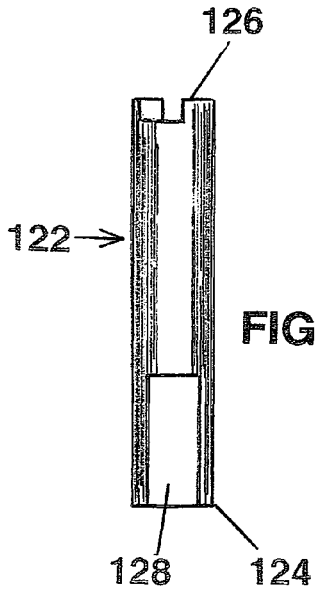
FIG. 13 depicts a front plan view of die 122 for wire bender 100 of this invention.
Figure 14:
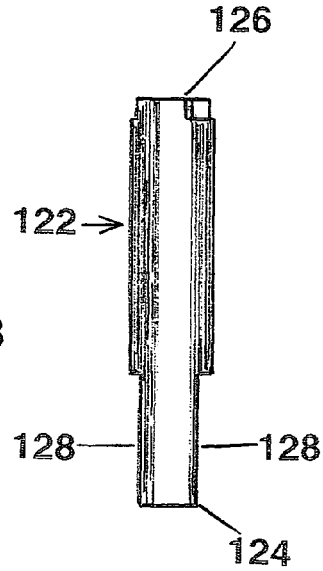
FIG. 14 depicts a side view of die 122 for wire bender 100 of this invention, and a reverse view of FIG. 11.
Figure 12:
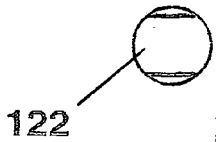
FIG. 12 depicts a bottom plan view of die 122 for wire bender 100 of this invention.

Further considering FIG. 8 and FIG. 9, the indicted movement arrow 158 of handle 162 affects the bending of wire 102. Die 122 of FIG. 8 forms a Z-bend. Die 122 of FIG. 9 forms an angle bend.

With the still further consideration of FIG. 10, FIG. 11, FIG. 12, FIG. 13, and FIG. 14, the structure of die 122 becomes clear. The die 122 has a mounting end 124 and an oppositely disposed shaping end 126. Mounting end 124 has flat sides 128. Mounting end 124 fits into mounting base 140 at die housing 146 in die receiver 150 (FIG. 2).

Finally adding FIG. 15 to the consideration, the bending of wire 102 with die 122 in wire bender 100 becomes clear. Wire 102 or a rod is inserted into a proper die 122 to be formed into a desired shape with the use of wire bender 100. Housing 120 is secured to surface 104 with fasteners 106 in mounting flanges 142. Fasteners 106 may be nails, screws or other items through apertures 108 (which are similar to apertures 138 in FIG. 2) in mounting flanges 142. In this manner, mounting base 140 of housing 120 is secured to surface 104 for use of die support 160.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A bender for a rod or a wire, adaptable to bend a variety of sizes of the rod or the wire to at least one desirable angle shape, comprising:

a) the wire bender including a housing with a die support movably and releasably mounted thereon;

b) the die support being adapted to receive a die to produce a desired shape for the wire or the rod;

c) the housing having a mounting base to receiving the die support;

d) a die fitting between the mounting base and the die support;

e) the die being secured sufficiently to at least reduce a rotation of the die about a longitudinal axis of the die;

f) the mounting base including a first mounting flange oppositely disposed from a second mounting flange;

g) the mounting base being securable to a desired surface;

h) the mounting base having a raised platform between the first mounting flange and the second mounting flange;

i) the die being mountable in a center of the raised platform;

j) the die support and the raised platform cooperating to support the die;

k) a die housing being centrally located within the raised platform;

l) the die housing including a die support mount adapted to have the die support rest thereon;

m) the die support including a die grip and a handle;

n) the handle extending from the die grip;

o) the die support mount including a die receiver;

p) the die receiver being an aperture with a first die flat oppositely disposed from a second die flat;
q) the die having a mounting end and a shaping end oppositely disposed therefrom;
r) the mounting end of the die having a first flat side with a second flat side oppositely disposed from the first flat side at the mounting end thereof;
s) the first die flat contacting the first flat side; and
t) the second die flat contacting the second flat side.

2. The bender of claim 1 further comprising:
a) the mounting end of the die being in a male to female relationship with the die receiver; and
b) the shaping end being adapted to receive the wire or the rod.

3. The bender of claim 2 further comprising:
a) the die grip including a shaping end receiver to receive the shaping end of the die;
b) the shaping end being the male portion of a male to female relationship with the shaping end receiver;
c) the shaping end receiver having a cylindrical housing;
d) the shaping end receiver having a first shaping support rod and a second shaping support rod between the shaping end receiver and the cylindrical housing;
e) the first shaping support rod and the second shaping support rod being on opposing sides of the shaping end receiver;
f) the first shaping support rod and the second shaping support rod being on opposing sides of the shaping end receiver to the cylindrical housing; and
g) the cylindrical housing having about the same diameter as the die support mount in order to rest thereon.

4. The bender of claim 3 further comprising:
a) the shaping end receiver having a first shaping support cylinder and a second shaping support cylinder on opposing sides thereof;
b) the first shaping support cylinder and the second shaping support cylinder being connected to both the cylindrical housing and the shaping end receiver;
c) the first shaping support cylinder receiving the first shaping support rod;
d) the second shaping support cylinder receiving the second shaping support rod; and
e) the shaping end of the die cooperating with the first shaping support rod and the second shaping support rod to shape the wire or the rod.

5. The bender of claim 4 further comprising:
a) the first mounting flange including a first aperture for mounting the bender to a desired surface;
b) the second mounting flange including a second aperture for mounting the bender to a desired surface; and
c) the die being changeable depending on the desired shape.

6. A bender for a rod or a wire, adaptable to bend a variety of sizes of the rod or the wire to at least one desirable angle or shape, comprising:
a) the wire bender including a housing with a die support movably and releasably mounted thereon;
b) the die support being adapted to receive a die to produce a desired shape for the wire or the rod;
c) the housing having a mounting base to receiving the die support;
about a longitudinal axis of the die;
d) the mounting base including a first mounting flange oppositely disposed from a second mounting flange;
e) the first mounting flange including a first mounting aperture;
f) the second mounting flange including a second mounting aperture;
g) the first mounting aperture and the second mounting aperture being adapted to receive a fastener and secure the bender to a surface;
h) the die having a mounting end and a shaping end oppositely disposed therefrom;
i) the mounting base having a raised platform between the first mounting flange and the second mounting flange;
j) the die being mountable in a center of the raised platform;
k) the die support and the raised platform cooperating to support the die;
l) a die housing being centrally located within the raised platform;
m) the die housing including a die support mount adapted to have the die support rest thereon;
n) the die support including a die grip and a handle;
o) the handle extending from the die grip;
d) the die support mount including a die receiver;
p) the die receiver being an aperture with a first die flat oppositely disposed from a second die flat;
q) the die forming two bends in the rod or the wire;
r) the mounting end of the die having a first flat side with a second flat side oppositely disposed from the first flat side at the mounting end thereof;
s) the first die flat contacting the first flat side; and
t) the second die flat contacting the second flat side.

7. The bender of claim 6 further comprising:
a) the mounting end of the die being in a male to female relationship with the die receiver; and
b) the shaping end being adapted to receive the wire or the rod.

8. The bender of claim 7 further comprising:
a) the die grip including a shaping end receiver to receive the shaping end of the die;
b) the shaping end being the male portion of a male to female relationship with the shaping end receiver;
c) the shaping end receiver having a cylindrical housing;
d) the shaping end receiver having a first shaping support rod and a second shaping support rod between the shaping end receiver and the cylindrical housing;
e) the first shaping support rod and the second shaping support rod being on opposing sides of the shaping end receiver;
f) the first shaping support rod and the second shaping support rod being on opposing sides of the shaping end receiver to the cylindrical housing; and
g) the cylindrical housing having about the same diameter as the die support mount in order to rest thereon.

9. The bender of claim 8 further comprising:
a) the shaping end receiver having a first shaping support cylinder and a second shaping support cylinder on opposing sides thereof;
b) the first shaping support cylinder and the second shaping support cylinder being connected to both the cylindrical housing and the shaping end receiver;
c) the first shaping support cylinder receiving a first shaping support rod;
d) the second shaping support cylinder receiving a second shaping support rod; and
e) the shaping end of the die cooperating with the first shaping rod and the second shaping rod to shape the wire or the rod.

10. The bender of claim 9 further comprising:
a) the die being changeable depending on the desired shape;

b) the die fitting between the mounting base and the die support; and c) the die being secured sufficiently to at least reduce a rotation of the die about its longitudinal axis.

11. A method for bending a wire for use in building a model for use as a toy or a utilitarian purpose comprising:

mounting a die in a wire bender, the wire bender having a housing and a die support movably and releasably mounted thereon;

supporting the wire in the die to provide a desired shape for the wire;

applying force to the wire to bend the wire to the desired shape with a handle of the die support;

the die support being adapted to receive the die to produce the desired shape for the wire or a rod;

the housing having a mounting base to receiving the die support; about a longitudinal axis of the die;

the mounting base including a first mounting flange oppositely disposed from a second mounting flange;

the first mounting flange including a first mounting aperture;

the second mounting flange including a second mounting aperture;

the first mounting aperture and the second mounting aperture being adapted to receive a fastener and secure the bender to a surface;

the die having a mounting end and a shaping end oppositely disposed therefrom;

the mounting base having a raised platform between the first mounting flange and the second mounting flange;

the die being mountable in a center of the raised platform;

the die support and the raised platform cooperating to support the die;

a die housing being centrally located within the raised platform;

the die housing including a die support mount adapted to have the die support rest thereon;

the die support including a die grip and the handle;

the handle extending from the die grip;

the die support mount including a die receiver;

the die receiver being an aperture with a first die flat oppositely disposed from a second die flat;

the die forming two bends in the rod or the wire;

the mounting end of the die having a first flat side with a second flat side oppositely disposed from the first flat side at the mounting end thereof;

the first die flat contacting the first flat side;

the second die flat contacting the second flat side; and securing the wire bender to the desired surface.

12. The method of claim 11 further comprising:

a) the mounting end of the die being in a male to female relationship with the die receiver;

b) the shaping end being adapted to receive the wire or the rod;

c) the die grip including a shaping end receiver to receive the shaping end of the die;

d) the shaping end being the male portion of a male to female relationship with the shaping end receiver;

e) the shaping end receiver having a cylindrical housing;

f) the shaping end receiver having a first shaping support rod and a second shaping support rod between the shaping end receiver and the cylindrical housing;

g) the first shaping support rod and the second shaping support rod being on opposing sides of the shaping end receiver;

h) the first shaping support rod and the second shaping support rod being on opposing sides of the shaping end receiver to the cylindrical housing; and i) the cylindrical housing having about the same diameter as the die support mount in order to rest thereon.

13. The method of claim 12 further comprising:

a) the shaping end receiver having a first shaping support cylinder and a second shaping support cylinder on opposing sides thereof;

b) the first shaping support cylinder and the second shaping support cylinder being connected to both the cylindrical housing and the shaping end receiver;

c) the first shaping support cylinder receiving the first shaping support rod;

d) the second shaping support cylinder receiving the second shaping support rod; and e) the shaping end of the die cooperating with the first shaping support rod and the second shaping support rod to shape the wire or the rod.

14. The method of claim 13 further comprising:

a) the die being changeable depending on the desired shape;

b) the die fitting between the mounting base and the die support; and c) the die being secured sufficiently to at least reduce a rotation of the die about its longitudinal axis.

* * * * *